US005782405A

United States Patent [19]

Vincent

[11] Patent Number: 5,782,405

[45] Date of Patent: Jul. 21, 1998

[54] RAILROAD TRACK COLLECTOR PAN SYSTEM

[76] Inventor: Jon R. Vincent, 4205 W. Jevon La., Lake Charles, La. 70605

[21] Appl. No.: 643,014

[22] Filed: May 2, 1996

Related U.S. Application Data

[63] Continuation-in-part of Ser. No. 173,778, Dec. 27, 1993, abandoned.

[51] Int. Cl.[6] ..... E01B 1/00

[52] U.S. Cl. ..... 238/2

[58] Field of Search ..... 238/2–9; 104/133; 404/2, 34, 64

[56] References Cited

U.S. PATENT DOCUMENTS

| | | | |
|---|---|---|---|
| 841,367 | 1/1907 | Zollinger | 238/7 |
| 1,408,134 | 2/1922 | O'Donnell | 238/2 |
| 2,492,177 | 12/1949 | Olsen | 238/7 |
| 3,773,255 | 11/1973 | Schoulties et al. | 238/2 |
| 4,010,896 | 3/1977 | Stockton | 238/2 |
| 4,296,884 | 10/1981 | Luebke | 238/2 |

*Primary Examiner*—Mark T. Le
*Attorney, Agent, or Firm*—Bush, Riddle & Jackson

[57] ABSTRACT

In accordance with illustrative embodiments of the invention, a drain basin system for collecting liquids and light solids that are spilled while loading or unloading a rail tank car includes a system of precast concrete pan members. Center pan members which are positioned between the rails have upwardly inclined flanges on their outer sides which extend partly over the plates of the rails, and outside pan members have identical flanges on their inner sides and upstanding walls on their outer sides. A pair of the system of pan members positioned end-to-end are arranged to have a higher elevation at the joint between them so that liquids run toward opposite ends where they enter trench drains either directly or via sealed tubular drains. Flashing strips cover the abutting joints, and also extend along the inclined flanges on opposite sides of each rail and up underneath the sides of the head thereof. In one embodiment, rigid tubes and flexible elastomer seal sleeves provide drain paths in a non-rigid connection.

12 Claims, 5 Drawing Sheets

RAILROAD TRACK COLLECTOR PAN SYSTEM

CROSS-REFERENCE TO RELATED APPLICATION

This application is a continuation-in-part of U.S. application Ser. No. 08/173,778 filed Dec. 27, 1993 now abandoned.

FIELD OF THE INVENTION

This invention relates generally to a pan structure located between and to the sides of railroad tracks to catch liquid and dry material spills and the like caused during loading or unloading of such materials, and particularly to a precast concrete pan structure having new and improved means to drain and collect spilled products.

BACKGROUND OF THE INVENTION

In order to protect the environment where railroad tank cars are unloaded or loaded with various chemicals, certain local, state and federal regulations require that these operations not contaminate the surrounding track area. One system which has been used employs fiberglass pans which may be clipped into place. However, due to their flexibility such pans tend to allow puddles of liquid to form on them, and fail to drain properly. Moreover, these members bolt together and are rigid where a cross-trench and pan connect, which allows puddles to collect at this joint. Other drawbacks are that they are slippery, and are complicated to assemble. When assembled they are not tight systems, as is desirable. Another pan system for example of the type shown in U.S. Pat. No. 3,773,255 includes steel sheets that bolt to one another and to the rails. This installation is quite complicated and expensive to make, and is very labor-intensive on account of the bolting that is required, since the pans are bolted to the webs of the rails which requires extensive drilling of new holes through thick metal. Of course the drilling of holes in the rails may be objectionable to the railway owner. The metal pans also are very slippery when covered with liquid substances. Still another pan system, shown for example in U.S. Pat. No. 4,010,896 has pans made of precast concrete, however the drain system used thereon is complex and complicated, and is considered to be expensive to make and install.

An object of the present invention is to provide a new and improved liquid collection pan system for a railroad car unloading zone which obviates the difficulties and disadvantages noted above.

Another object of the present invention is to provide a new and improved system of the type described which has pans made of precast concrete which rest on the ties, but are not otherwise connected thereto in order to provide for simple and easy installation.

Another object of the present invention is to provide a new and improved system of the type described where the pans have a built-in taper from where they abut toward each end which promotes run-off toward a depressed drain member by which the spilled liquids can be piped to a container.

Still another object of the present invention is to provide a system of the type described where liquids spilled onto the rails of the track themselves is made to run off into the pans.

SUMMARY OF THE INVENTION

These and other objects of the present invention are attained in accordance with the present invention through the provision of a pan system including individual precast concrete pan members positioned between and to the sides of the rails and supported on the cross-ties. Each outside pan member and each center pan member has an upwardly inclined wall adjacent a respective rail, and upwardly inclined flashing strips are attached along each inclined wall and extend underneath the head of a rail to promote run-off of liquids spilled on the tracks. A transverse drain means is located at one end of each set of pan members whose upper surfaces are sloped to cause run-off of liquids toward such drain means. In one embodiment the drain means are an open-topped, elongated box that is seated between a pair of the cross-ties and adapted to receive the run-off through grates that are supported by the pan members. In another embodiment the adjacent end sections of the pan members have holes cast therein which receive the upper portions of drain tubes mounted therein with elastomeric seal sleeves. The lower section of each drain tube fits through a hole in the upper wall of an enclosed drain box or pipe baffle with another elastomeric seal preventing any leakage. The seals also are somewhat flexible to allow for movement of the tracks without disturbing same. A small grate covers the upper end of each drain tube. The elastomer seals and the drain tubes which fit in and between the seals provide flexible yet sealed connectors between the pan members and the transverse drain member. The structure allows dynamic movements of a railroad track structure when a non-rigid connection is essential.

BRIEF DESCRIPTION OF THE DRAWINGS

The present invention has these as well as other objects, features and advantages which will become more clearly apparent in connection with the following detailed disclosure of a preferred embodiment, taken in conjunction with the appended drawings in which.

DETAILED DESCRIPTION OF A PREFERRED EMBODIMENT

Figure 1:
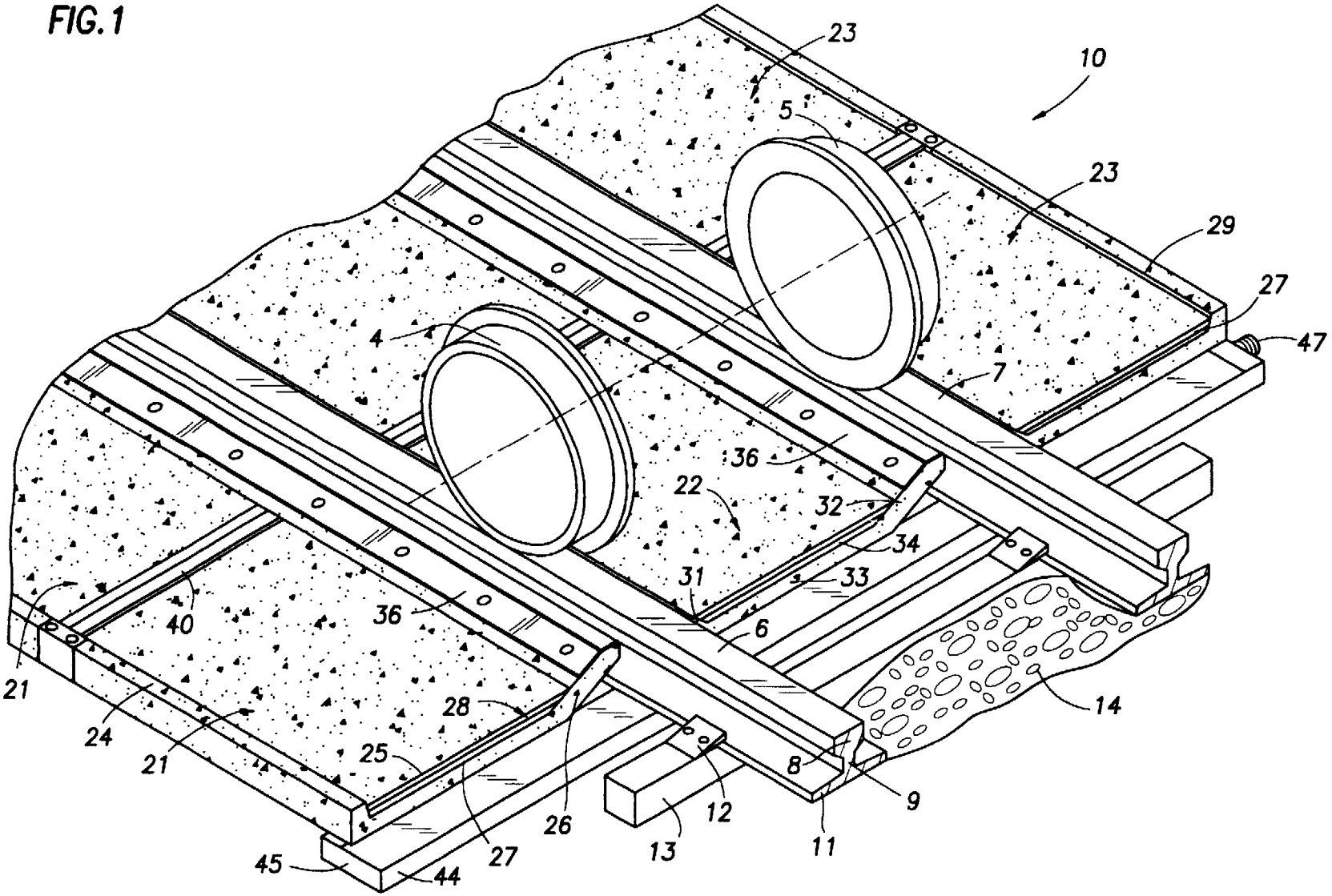
FIG. 1 is a perspective view of a pan system in accordance with this invention and positioned in a track area where a tank car is loaded or unloaded.

Referring initially to FIG. 1, a pan collection system in accordance with the present invention and indicated generally at 10 is shown installed where a railroad tank car (not shown) is to be loaded and unloaded, such car having wheels 4 and 5 which ride on rail members 6 and 7. Each of the rails 6 and 7 have a head 8 which is above a web 9 that is an integral part of the base of the rail 11. The base 11 is supported on the plates 12 which are nailed down to cross-ties 13. The ties 13 rest in a bed of ballast gravel 14 on the road bed. In order to prevent liquids and solids being unloaded from or loaded into the tank car from running off into the road bed, or soaking into it where they might migrate into water supplies, the protective pan system 10 in accordance with the present invention is employed. The pan system 10 also can be used at a fueling facility or at any other location where spilled liquids or solids represent a hazard or possible contamination to the environment.

The pan system 10 includes a plurality of rectangular concrete pans 21–23 which are laid between the rails 6 and 7 as well as to either side thereof. The outer pan 21 has a side wall 24, a floor 25, and an inner wall 26 that inclines upward toward the bottom of the rail head 8. A grate seat 27 can be formed across the end 28 of the pan 21 for purposes to be described later. The opposite side pan 23 is identically constructed but has a reverse orientation so that the wall 29 is on the outside.

The center pan 22 is similar in construction to a side pan 21 or 23 except that it has inclined walls 31, 32 on both sides. Otherwise the pan 22 has a bottom section 33 and a grate seat 34. Each of the pans 21–23 is precast out of appropriately reinforced concrete and has a length that is suitable for easy handling, such as about 10 to 12 ft. Each center pan 22 has a width which will fit properly between standard gauge track.

Figure 3:
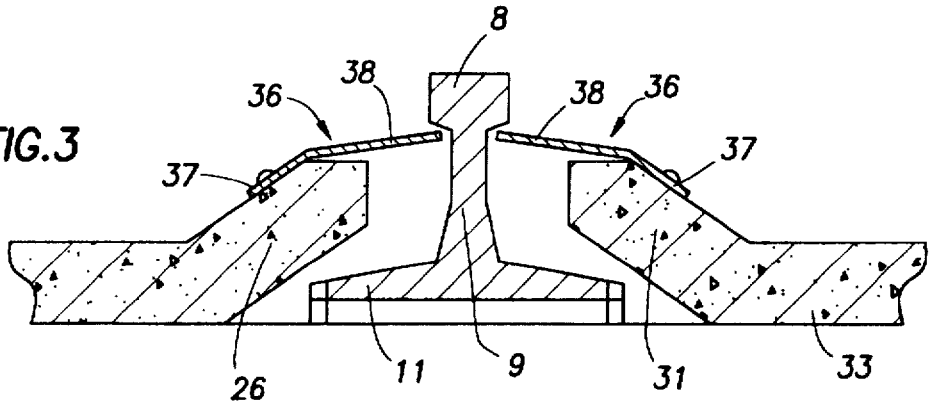
FIG. 3 a fragmentary, enlarged cross-section taken on line 3—3 of FIG. 2.
Figure 4:
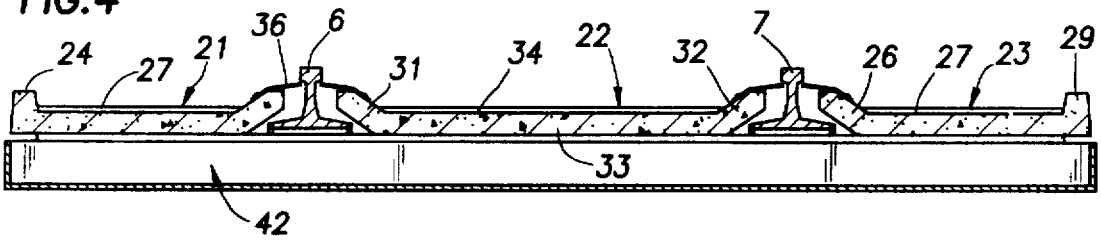
FIG. 4 is a cross-section taken on line 4—4 of FIG. 2.
Figure 5:
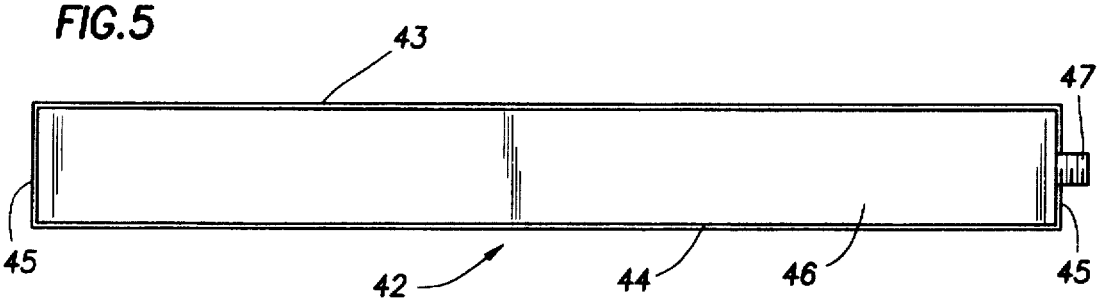
FIG. 5 is a top view of a transverse drain box which receives run-off from the pans.

In order to cause any liquid that is spilled on or near a rail to drain onto the floor of a pan, a flashing strip 36, made of metal or hard plastic, is attached to the inclined flanges of each pan member on the opposite sides of each rail 6 and 7. As shown in FIG. 3, each strip 36 has an outer portion 37 which inclines downwardly along the outwardly facing wall of the flange and is fastened thereto by any suitable means, and an inner portion 38 which tucks under the outer edge of the rail head 8 and inclines upward at a less severe angle. As the inner flange of a wheel 4 or 5 on the car rolls along the track, the inner portion 38 can flex downward and then resile back upward as the wheel passes. On the other hand the portions 38 can be inclined such that they are not contacted by a wheel flange. In any event it can be seen that any liquid spilled on the heads 8 of the rails will run down onto the flashing strips 36 and drain into the pans 21–23.

Figure 2:
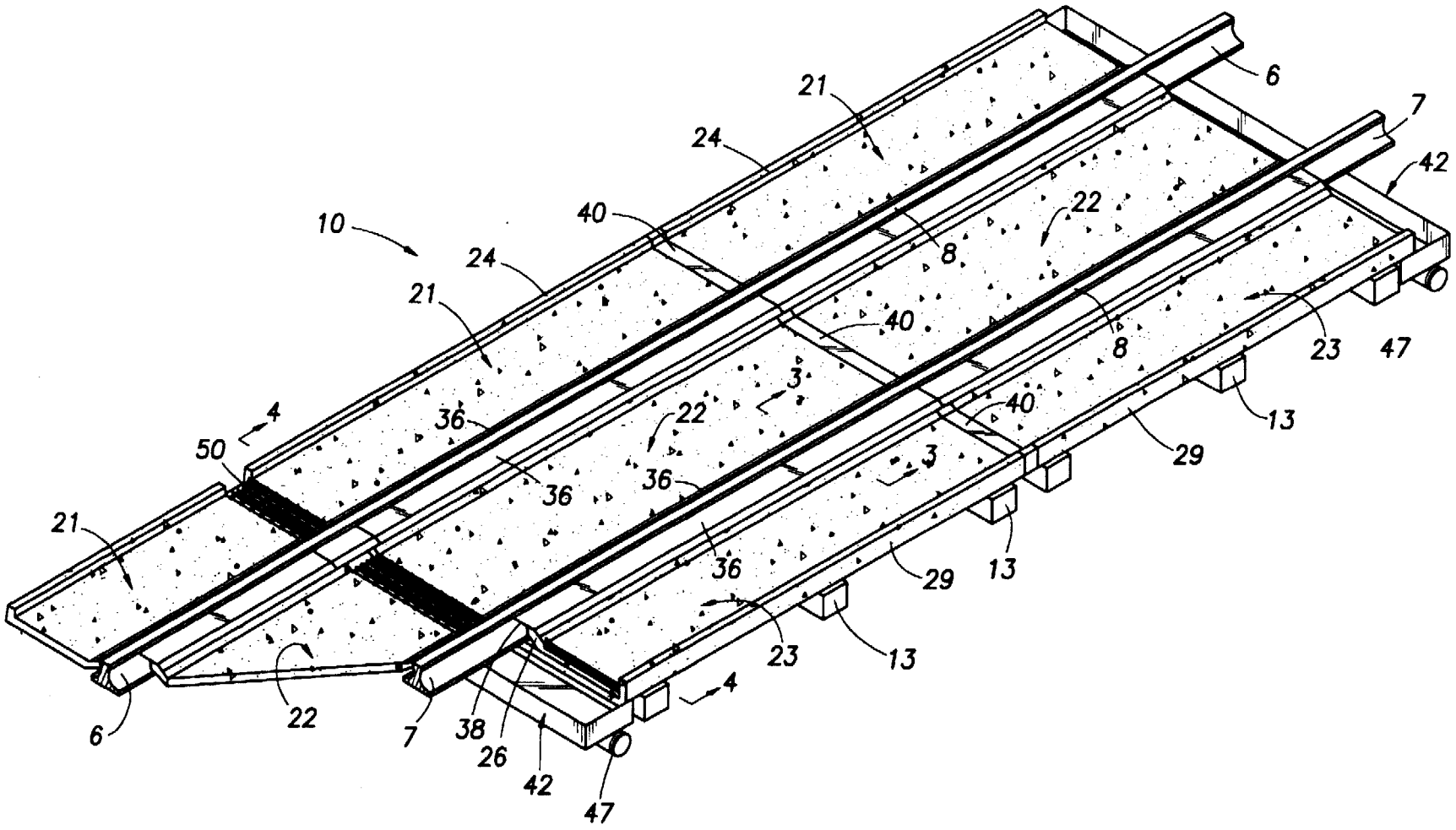
FIG. 2 is another perspective view which illustrates various components of the invention.

As shown more clearly in FIG. 2, the adjacent ends of the pans 21–23 are covered by metal flashing strips 40 which cover the end seam between them as well as abutting surfaces of the walls 30. Thus no liquid can get through the pan system which falls thereon.

As shown in FIGS. 1, 2, 4 and 5 a trench drain 42 which extends transverse to the rails 6 and 7 is positioned between the spaced-apart ends of alternating sets of pans 21–23. As shown by the phantom lines in FIG. 1, the side wall 43 of the trench drain 42 is positioned back underneath the outer ends of the pans 21–23 so that they overhang the trench drain somewhat. Such overlapping also exists with respect to the opposite side wall 44 and the next set of pans. The trench drain 42, which preferably is made of stainless steel sheet metal, has end walls 45 and a bottom wall 46, but is open-topped, as shown. A drain fitting 47 adjacent one end is connected to additional pipes (not shown) by which liquids can be collected in a secondary containment structure (not shown). As shown in FIG. 1, the trench drain 42 is nestled in the ballast gravel, and is not supported in any way by the ties 13. The trench drain 42 is arranged in the ballast 14 such that its bottom slopes toward the desired fitting 47. Grating 50 (FIG. 2) rests on the cast-in-place grate seats 27, 34 of the pans 21–23, to provide a protection against any one walking along the track from stepping into or on the trench drains 42. For purposes of illustration, the right side of FIG. 2 shows a system which ends with trench drain 42, and so successive pan members are used. Of course the trench drain 42 will have a grating 50 (not shown) resting on the top thereof, as will the lower end portion of the trench drain shown on the left side of this drawing figure.

Figure 6:
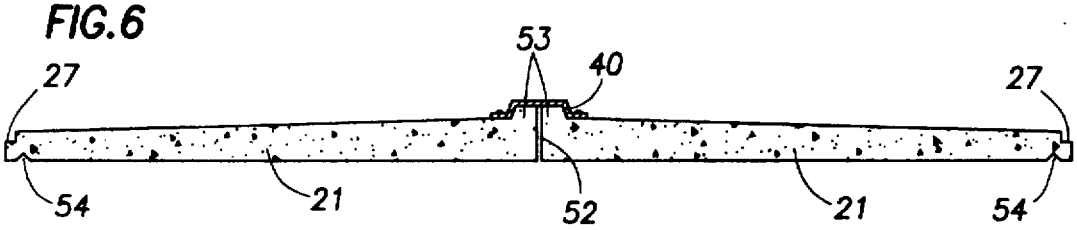
FIG. 6 is a longitudinal cross-section of abutted pan members having sloped upper surfaces.

As shown in FIG. 6, each of the pans 21–23 has a slope fabricated into its upper surface such that when resting on the cross-ties 13 any spilled liquid tends to run toward a trench drain 42. That is to say the elevation of the joint 52 between the ends of the pairs of pans 21–23 at the flashing strips 40 is higher than the elevation of the upper edges of the pans where the grates 50 are located. Thus there is no tendency for any liquid to stand or puddle, so that workers might have to walk through it. This unique characteristic also allows for the washdown of solids into the trench drains. End walls 53 on each pan can be provided, in which case the flashing 40 is generally U-shaped in section with flanges extending outward on each side. If desired grooves 54 can be formed on the lower sides of the seats 27 to provide drip ledges.

Figure 7:
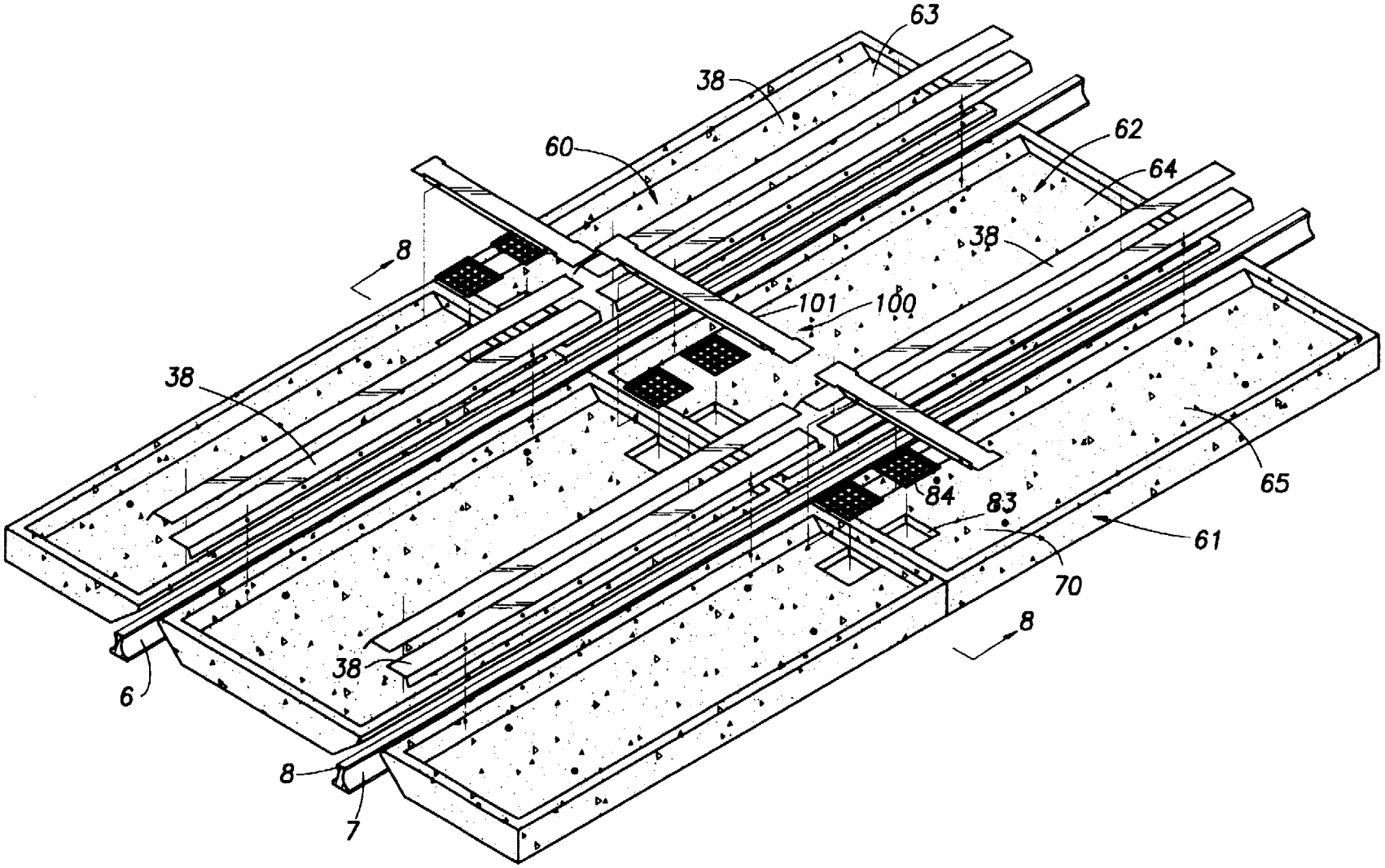
FIG. 7 is a perspective exploded view of another embodiment of the present invention.
Figure 8:
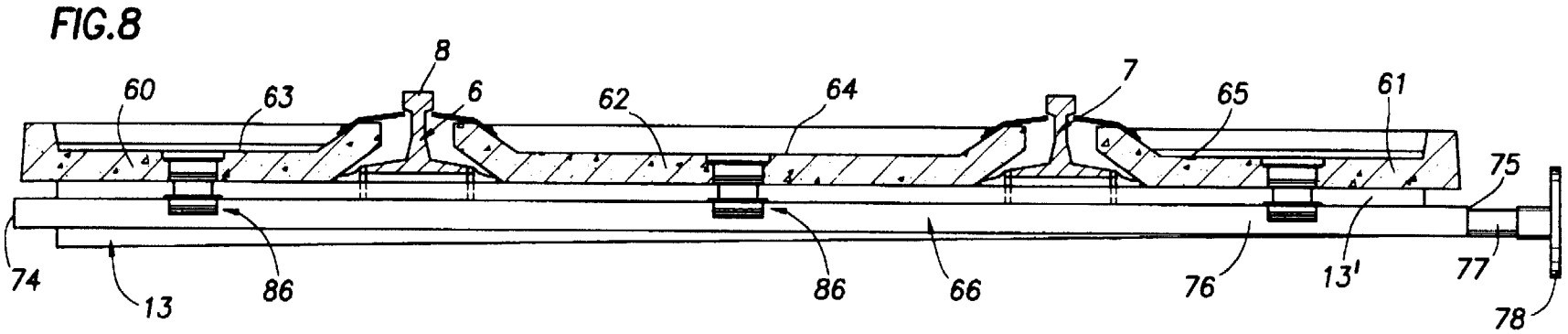
FIG. 8 is a sectional view on line 8—8 of FIG. 7.
Figure 9:
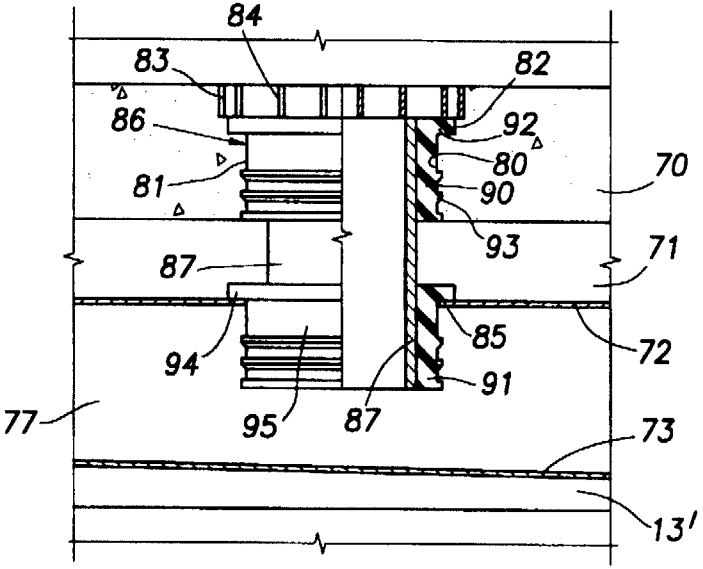
FIG. 9 is an enlarged view, partly in section, of a drain assembly used in this embodiment.

Another embodiment of the present invention is shown in FIGS. 7–9. As in the previous embodiment, generally rectangular side drain pans 60, 61 and a center drain pan 62 made of precast reinforced concrete are positioned adjacent the rails 6 and 7 and are supported by the cross ties 13 (FIG. 8). The distal ends of the pans 60–62 are thicker so that the upper surfaces 63–65 of each respective pan 60–62 is sloped downward toward a transverse drain box or pipe baffle 66 at about ½ inch per foot of length so that any liquid falling on such upper surfaces will naturally run toward such box. The drain pans 60–62 are arranged in alternating sets along the rails 6 and 7 with adjacent ends abutting one another. The drain box 66 is located in a trench preferably between two switch ties 11' that are somewhat longer than the standard ties 13. An end portion 70 of each drain pan 60–62 overlies about one-half the width of the drain box 66, there being a clearance space 71 between the lower surfaces of such portions and the upper wall 72 of the box.

The drain box 66 has a substantially closed construction including the upper wall 72, a lower wall 73, end walls 74, 75 and side walls 76, 77. As shown in FIG. 8, each of side walls 76, 77 has a height that is tapered from a minimum at the end wall 74 to a maximum at the end wall 75 to provide a sloping lower wall 73 that drains any liquid inside the box or baffle 66 toward a drain pipe 77 that extends through, and outward from, the end wall 75. A flange 78 is threaded to the outer end of the drain pipe 77 to connect the same to a collection manifold (not shown).

As shown in FIG. 9, a drain hole 80 is formed in the center of each overlapped end portion 70 of the respective drain pans 60–62. Each hole 80 has a cylindrical opening 81, a counterbore 82 at the upper end of the opening 81, and a square recess 83 at the upper end of the counterbore. The recess 83 is sized and arranged to receive a square grate member 84 as shown in FIG. 7. The upper wall 72 of the transverse drain box 66 is provided with circular openings 85 vertically aligned with the drain holes 80. A drain assembly indicated generally at 86 is received in each set of openings 80, 85 and includes a tube 87, made of PVC or stainless steel, and a pair of upper and lower elastomer seal sleeves 90, 91, preferably of identical construction. The upper seal sleeve 90 fits tightly on the tube 87 and has an upper annular shoulder 92 that seats in the counterbore 82. The sleeve 90 also has several external, upwardly facing and outwardly projecting ribs 93 that provide a liquid-tight seal against the inner wall of the opening 80. The shoulder 94 on the lower seal sleeve 91 rests against the top of the drain box 66, and the smooth portion 95 of the sleeve fits tightly through the opening 85. The tube 87 provides internal support for each of the seal sleeves 90, 91, however a degree of flexibility is provided by the resilience of the elastomer seal sleeves 90, 91.

Each of the drain assemblies 86 can be easily installed at the site by pushing the lower seal sleeve 91 into an opening 85, mounting the upper sleeve 90 on the tube 87 as shown, and then pushing the assembled tube and upper seal sleeve down through the drainhole 80 until the lower end portion of the tube is within the bore of the lower seal sleeve 91 and the annular shoulder 92 seats in the counterbore 82. Then the grate member 84 is dropped into the recess 83 to complete the assembly. The external ribs 93 provide sealing engagement with the walls of the drainhole 80 to prevent any liquids on top of the pans 60–62 from leaking therepast and into the ballast.

As shown in FIG. 7, thin metal flashing strips 100 having downwardly bent side edges 101 are secured to overlay the joint between the abutting end walls of the pans 60–62 to prevent leakage at this joint. As in the previous embodiment, elongated metal flashing strips having their outer sides secured to the inclined pan walls and their outer edges extending underneath the sides of the heads 8 of the rails 6 and 7 slope inwardly and upwardly to promote run-off into the pans 60–62 of any liquids spilled thereon. If desired, inserts can be embedded in the pan walls to receive screws by which the flashing strips are attached.

OPERATION

In operation and use of the first-described embodiment of the present invention, the pans 21–23 are made out of precast concrete so that dimensions and other design parameters can be closely controlled. To install the system, the trench drains 42 are installed at suitable spacings underneath the tracks, and the drain pipes can also be hooked up at this time, if desirable. All ballast gravel, if any, is removed from on top of the cross-ties. Then the lifting eyes (not shown) which are connected to the pans 21–23 as cast are used with lifting equipment to position the pans as shown in FIGS. 1 and 2 where the pans are supported on the cross-ties 13. The metal flashing strips 40 and 36 are installed and finally the grate members 50 are laid down to complete the assembly.

Any spilled liquids are contained by the pans 21–23 and run off in opposite directions from the flashings 40 toward the pan ends when they flow through the grates 50 into the trench drains 42. The outer walls 24 and 29 prevent liquids from spilling into the ballast to the sides of the pans, and the inclined walls 26 and 31 provide dams against flow toward the rails 6 and 7. The longitudinal flashing strips 36 direct the flow of any liquids spilled on the rails 6 and 7 into the pans 21–23. The drain fittings 47 of the trench drains 42 are hooked up to suitable lines which lead to a collection facility.

The operation and use of the embodiment shown in FIGS. 7–9 is similar except that any spilled liquids enter the trench box 66 via the drain assemblies 86 in the thinner end portion of each pan. The drain tube 87 of each assembly 86 extends down into the trench box 66 through a hole in its top wall, and the lower wall of the box 66 is sloped so as to provide run-off toward the drain end 75 so that any liquids quickly flow into the drain pipe 77 and enter the collection manifold. The adjacent ends of each longitudinal pair of drain pans abut one another as shown in FIG. 7, and the transverse flashing strips 100 cover the abutment joints.

It now will be recognized that a new and improved chemical spill collection system for a railroad unloading or loading terminal has been disclosed. The system includes pans having a built-in taper which promotes run-off and inhibits puddling, as well as flashing strips, retaining walls and drains which ensure that spilled liquids cannot reach the ties or ballast underneath and to the sides of the rails. Since certain changes or modifications may be made in the disclosed embodiments without departing from the inventive concepts involved, it is the aim of the appended claims to cover all such changes and modifications falling within the true spirit and scope of the present invention.

What is claimed is:

1. In combination with a pair of rails supported on cross ties and ballast of a railroad track; an improved pan collection system for causing run-off of a liquid or light solids spilled while unloading a rail car supported on said rails and cross ties; said pan collection system comprising:

a plurality of sets of drain pan members arrangement end-to-end and supported by said cross ties and ballast, each of said sets of pan members including a center pan member positioned between said rails and outside pan members positioned respectively on opposite sides of said rails and said center pan member;

a transverse elongate drain conduit positioned between a pair of adjacent cross ties below said pan members and having an upper surface spaced vertically from said pan members;

a pair of spaced generally vertically aligned openings in each of said pan members and said transverse drain conduit;

a generally vertically extending tubular member mounted in each pair of generally vertically aligned openings; and resilient means adjacent said tubular member to permit limited movement of said pan members relative to said transverse drain conduit.

2. The combination as set forth in claim 1 wherein said resilient means comprises an elastomeric seal positioned about said tubular member and fitting within said vertically aligned opening in said drain conduit to provide a generally fluid tight seal thereat.

3. The combination as set forth in claim 1 wherein said resilient means comprises an elastomeric seal positioned about said tubular member and fitting within said vertically aligned opening in one of said pan members to provide a generally fluid tight seat thereat.

4. The combination as set forth in claim 1 wherein said resilient means comprises an elastomeric sleeve fitting about an upper end portion of each of said tubular members and received within said vertically aligned opening in one of said pan members a generally fluid tight relation.

5. The combination as set forth in claim 4 wherein said elastomeric sleeve has a laterally extending upper annular shoulder; said vertically aligned opening in said one pan member has a counterbore receiving said shoulder in abutting relation; and a grate is positioned in said counterbore over said tubular member and said elastomeric sleeve.

6. The combination as set forth in claim 5 wherein said elastomeric sleeve has a plurality of outer annular ribs thereon engaging said one pan member to provide a liquid tight seal therewith.

7. The combination as set forth in claim 1 wherein said drain conduit is box shaped including a plurality of rectangular walls.

8. The combination as set forth in claim 1 wherein an upper elastomeric seal sleeve fits about said tubular member within said opening in one of said pan members for providing a generally liquid tight seal thereat; and a lower elastomeric seal sleeve fits about said tubular member within said opening in said enclosed drain conduit for providing a generally liquid tight seal thereat.

9. A drain pan structure for causing run-off of a liquid or light solids from rail cars supported on rails and cross ties; said pan structure comprising:

a drain pan member for fitting between the rails;

an elongate transverse drain conduit for fitting between a pair of adjacent cross ties below said pan member and having an upper surface spaced below said pan member;

a pair of aligned openings in said pan member and said transverse drain conduit;

a tubular member mounted within and extending between said pair of aligned openings; and resilient means adjacent said tubular member to permit limited transverse movement between said pan member and said transverse drain conduit.

10. A drain pan structure as set forth in claim 9 wherein an elastomeric sleeve is positioned within each of said aligned openings about said tubular member for sealing thereabout and to permit limited flexure of said drain pan member.

11. A drain pan structure as set forth in claim 10 wherein one of said elastomeric sleeves has an upper laterally extending annular shoulder; and said opening in said pan member has a counterbore receiving said shoulder in abutting relation; and a grate is positioned in said counterbore over said tubular member and said one elastomeric sleeve.

12. A drain pan structure as set forth in claim 11 where said one elastomeric sleeve has a plurality of outer annular ribs thereon engaging said drain pan member to provide a liquid tight seal therewith.

* * * * *